US005562214A

United States Patent [19]

Castañeda et al.

[11] Patent Number: 5,562,214

[45] Date of Patent: Oct. 8, 1996

[54] PROCESS AND APPARATUS FOR SORTING MATERIAL

[75] Inventors: Fernando Castañeda; Arturo C. Aguero, both of San Jose, Costa Rica

[73] Assignee: Xeltron Internacional S.A., El Dorado, Panama

[21] Appl. No.: 129,848

[22] Filed: Sep. 30, 1993

[51] Int. Cl.[6] ..... B07C 5/00

[52] U.S. Cl. ..... 209/564; 209/580; 209/587; 209/908; 209/938; 250/226

[58] Field of Search ..... 209/564, 576, 209/577, 580, 581, 582, 586, 587, 588, 908, 938; 250/223 R, 226; 356/73, 408, 416, 445

[56] References Cited

U.S. PATENT DOCUMENTS

| | | | |
|---|---|---|---|
| 4,057,146 | 11/1977 | Castaneda et al. | 250/226 X |
| 4,350,442 | 9/1982 | Arild et al. | 209/587 X |
| 4,718,558 | 1/1988 | Castaneda | 209/581 X |
| 4,863,041 | 9/1989 | Bailey | 209/580 |
| 4,946,045 | 8/1990 | Ditchburn et al. | 209/586 X |
| 5,158,181 | 10/1992 | Bailey | 209/587 X |

FOREIGN PATENT DOCUMENTS

| | | | |
|---|---|---|---|
| 2165644 | 4/1986 | United Kingdom | 209/581 |

*Primary Examiner*—William E. Terrell
*Assistant Examiner*—Tuan Nguyen
*Attorney, Agent, or Firm*—Seed and Berry LLP

[57] ABSTRACT

An apparatus for optically sorting small objects such as beans has an annular analysis head with an opening through which the objects fall. Three sets of optical fibers are positioned around the analysis head opening. A first set receives radiant light reflected from the falling objects. This reflected light is digitized and input to a comparator where the reflected light is compared to a reference value and a determination as to the quality of the object is made based on color. The second set of fibers is connected to an infrared light source and transmits a curtain of light across the opening, intercepting the travel of the objects. The third set of fibers receives the infrared light and is connected to a light detector which detects when objects pass through the curtain of light. The curtain of light is preferably wider than the objects. The light detector outputs a signal having peaks caused by the widest portions of objects passing through the light curtain. The peaks correspond closely with the centers of gravity of the objects. A comparator outputs an ejection signal in response to a signal from the quality detector below the reference value and the peak produced by that object. The peaks are used to time an ejection mechanism.

29 Claims, 6 Drawing Sheets

PROCESS AND APPARATUS FOR SORTING MATERIAL

TECHNICAL FIELD

The present invention generally relates to optical sorting machines for sorting individual objects such as beans, grains, fruit and the like.

BACKGROUND OF THE INVENTION

Objects such as beans, grains, fruits and similar small-sized objects have been generally sorted using optical sorting apparatus. The objects pass through the apparatus where they are irradiated by visible light, ultraviolet light, infrared light, or other electromagnetic radiation such as microwaves. A detector generates an electric signal derived from light reflected from the object. If the sorting is based either in whole or in part on the color of the object, then at least two detectors produce electrical signals related to light reflected from the object and detected by the detectors. Electronic circuitry processes the signals from the detectors and determines if the object should be or rejected by additional apparatus in the sorting device.

Many prior art sorting systems reject objects based upon color alone. Specifically, nominally identical light signals are directed to photo detectors whose response characteristics peak in different areas of the light spectrum. Thus, the output signal from each detector indicates the reflectance of: the object at the wavelengths at which the detectors peak. The various outputs are compared and, based upon a reference value, a decision whether to accept or reject the object is made. For example, if the object had an unacceptable color, the reflectance of the object at a certain wavelength would be below the reference value. The apparatus would then output a signal to a rejecting mechanism to have the particular object rejected.

U.S. Pat. No. 4,057,146 is an example of such a prior art sorting apparatus. Objects fall one at a time through a ring of detectors in which light is reflected off each object. Light at the predetermined wavelength or two colors of light is detected and processed, and a rejecting mechanism activated if the object has an unwanted color or if the object is too small. To prevent generating spurious signals, the electronic quality analysis apparatus is self-synchronized, in that synchronizing signals are derived from the signals generated by the reflecting light itself. This apparatus should not be enabled when an object is not in the analysis zone. Similarly, the rejecting apparatus, which is activated by a rejection signal generated by the analyzing apparatus, should not be enabled when an object is not in the analysis zone.

A problem with this prior sorting apparatus sorts based on color is that very dark objects are difficult to detect. A black body, by definition, absorbs all light so little, if any, light is reflected from such a body. Thus, a black object that should be rejected passes through the sorting apparatus undetected, and reduced the effectiveness of the sorting apparatus. This is particularly a problem when black beans need to be sorted out of lighter color beans.

It will therefore be appreciated that a significant need exists for a sorting apparatus which is able to sort very dark colored objects from light color objects. The present invention fulfills this need, and further provides other related advantages.

SUMMARY OF THE INVENTION

A method and apparatus for sorting individual samples of materials is disclosed. The apparatus uses the synchronized detection of the quality of an object with the detection of the presence of the object. The apparatus optically sorts objects falling over an unimpeded path by employing an analysis assembly, a quality detector, an interrupt detector, and a comparator. The analysis assembly has a plurality of optical fibers spaced around an annular ring through which the objects fall. Light reflected off the objects is transmitted by the optical fibers to the quality detector. A set of optical fibers transmits a plane of light which intercepts the unimpeded path. This plane of light is generally wider than the objects being sorted. The interrupt detector includes a light detector which receives the plane of light and outputs a presence signal when an object obstructs the plane of light. The comparator, preferably a central processing unit, compares a signal output from the quality detector with a signal from the interrupt detector. Based on this comparison, the sorting apparatus determines whether an object is to be ejected.

The central processing unit executes a routine for sorting the objects. The routine includes the steps of: (1) reading an immediate value from the interrupt detector; (2) comparing the immediate value with a previous value and producing a result; (3) reading in a value from the quality detector if the result is less than or equal to a predetermined value (e.g., zero); and (4) producing a signal indicating that an object is to be ejected if the quality signal is less than a reference value.

Other features and advantages of the present invention will become apparent from studying the following detailed description of the presently preferred exemplary embodiment, together with the following drawings.

DETAILED DESCRIPTION OF THE PRESENTLY PREFERRED EXEMPLARY EMBODIMENT

Figure 1:
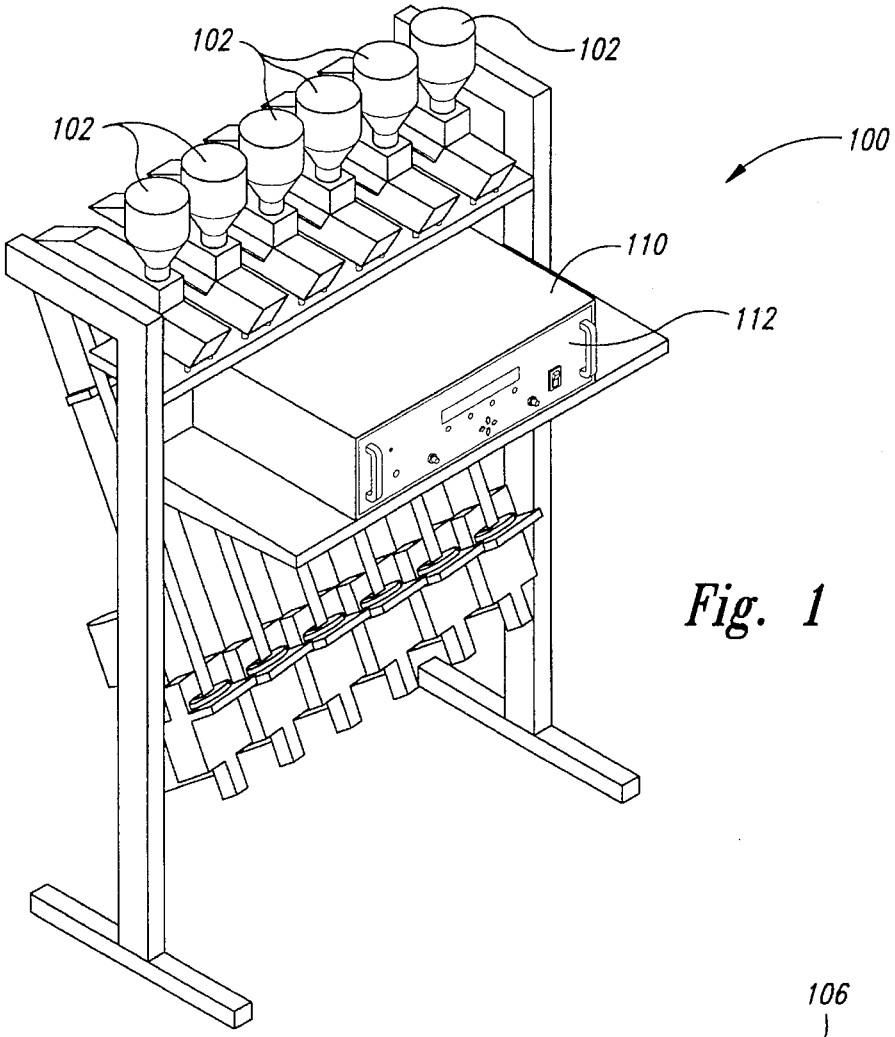
FIG. 1 is an isometric view of a sorting apparatus embodying the present invention.
Figure 2:
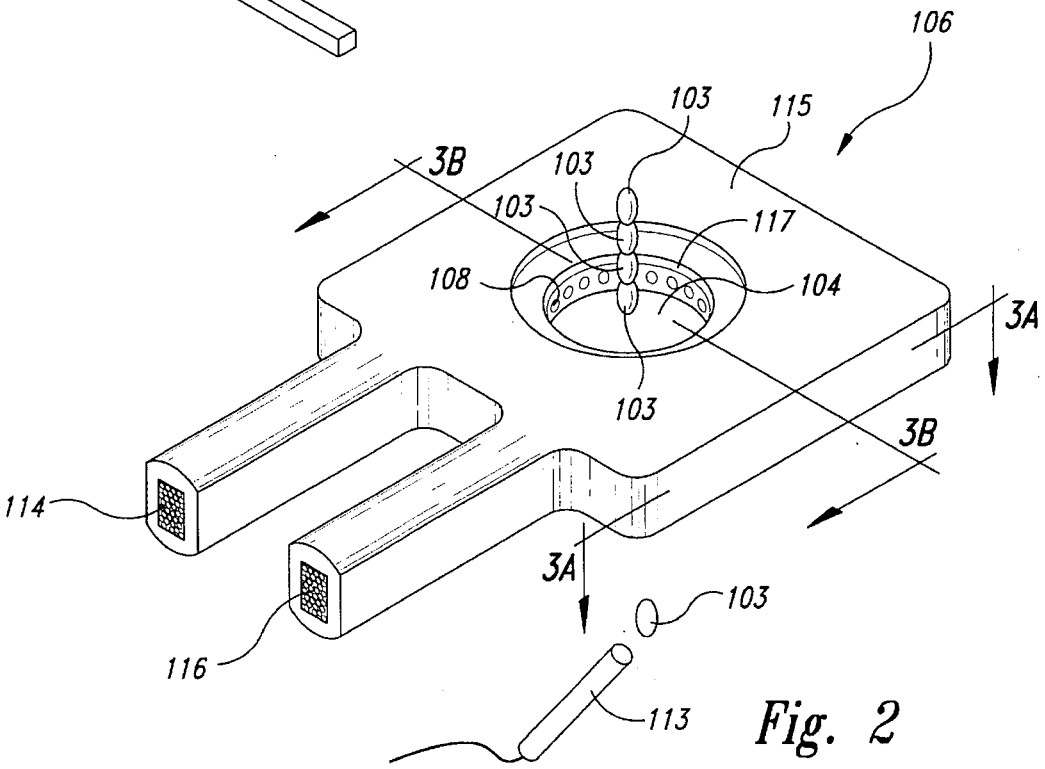
FIG. 2 is an enlarged isometric view of an analysis head used with the sorting apparatus of FIG. 1.

An optical sorting apparatus 100 incorporating the present invention is shown in FIG. 1. The apparatus 100 is illustrated as having six channels, each having a hopper 102 in which objects to be sorted such as beans are loaded. The objects pass from the hopper 102 in a controlled fashion to provide a continuous flow and a uniform distribution of objects. The objects, indicated by reference numeral 103 in FIG. 2, are released separately and fall one-by-one, under the influence of gravity, through a central opening 104 in the center of an analysis head 106, as best shown in FIG. 2. White light illuminates the objects as they pass through the opening 104 by a plurality of lamps (not shown). The apparatus is similar to that described in U.S. Pat. No. 4,057,146, which is incorporated herein by reference.

The light is reflected off the objects 103 and onto a plurality of optical fibers 108 arranged with one of their ends spaced-apart in a row about the opening 104 of the analysis head 106. As shown in FIG. 2, the optical fibers 108 are bundled into two bundles 114 and 116. The optical fibers are preferably east in a plastic head unit. A ring 117, preferably of aluminum, receives the end of the optical fibers 108 arranged about the opening 104, the ring 117 secured to the head unit 115 about the opening 104.

A signal analyzer 109 (shown in FIG. 5) for the apparatus 100 receives the other ends of the optical fibers 108 and thus the light transmitted or conducted through these fibers. Those of ordinary skill in the art will appreciate that the optical fibers will transmit light reflected from the object 103 as it passes through the opening 104 of the analysis head 106, and that any means of transmitting light from the analysis head to the signal analyzer 109 may be used. The signal analyzer 109 is housed in a control unit 110 having a control panel 112 which displays information and allows the operator to control the apparatus 100, including the setting of various reference values discussed below.

The signal analyzer 109 of the present invention is able to detect the presence of an object, independent of its size or color. In prior quality detecting systems, the signal output by these systems in response to either a very dark object acting as a black body or no object are substantially identical and thus would not properly eject such an object. In the present invention, the quality of the object is detected using known methods, such as that disclosed in U.S. Pat. No. 4,057,146 or 4,718,558, and a quality signal produced. The quality signal is correlated with a signal indicating the presence of the object within the light curtain 126, and an appropriate signal generated to eject an undesired object generated, as described more fully below. By correlating the quality signal with the presence signal, the present invention is able to properly sort very dark objects from light objects.

Figure 3A:
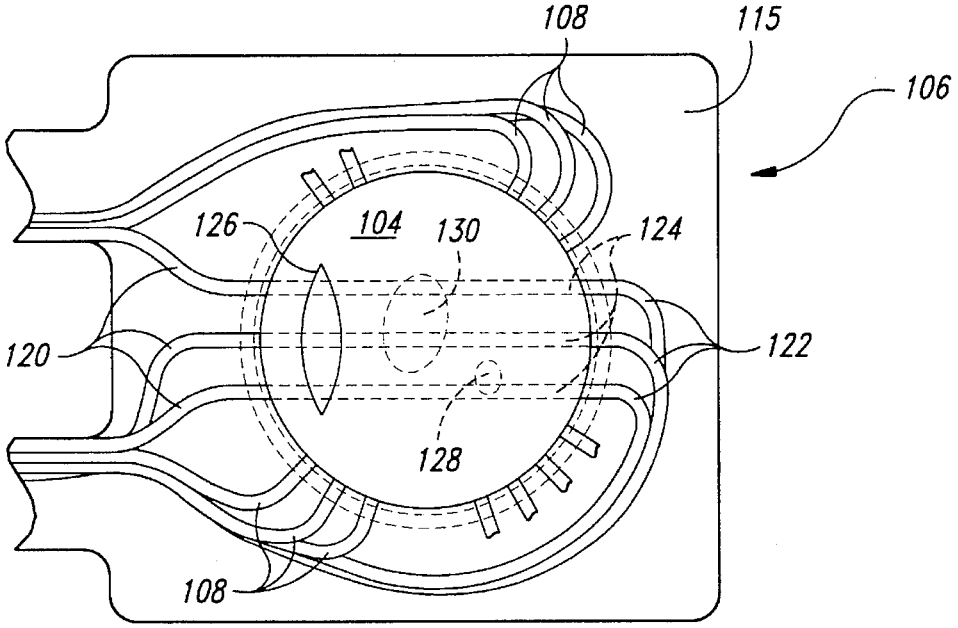
FIG. 3A is an enlarged cross-sectional top view of the analysis head taken substantially along line 3A—3A of FIG. 2.
Figure 3B:
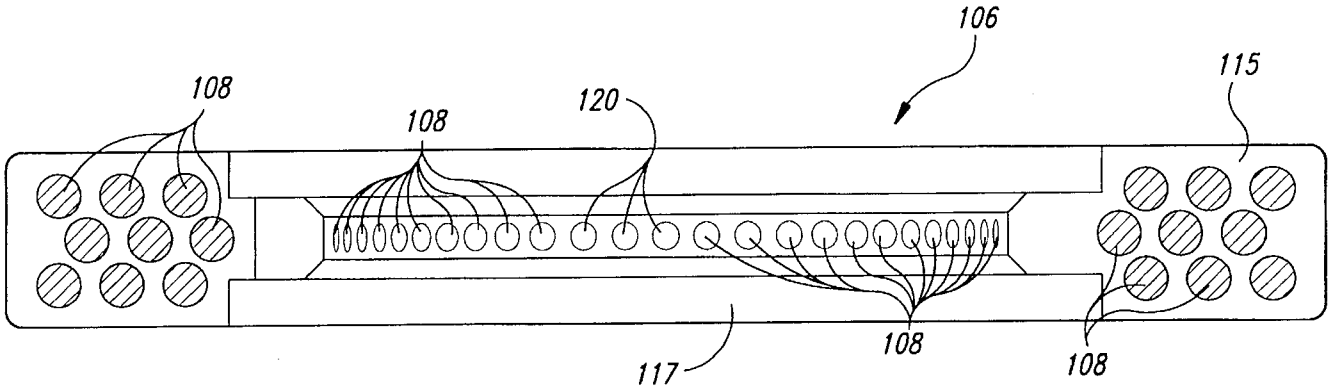
FIG. 3B is an enlarged cross-sectional side view of the analysis head taken substantially along line 3B—3B of FIG. 2.

FIGS. 3A and 3B show the analysis head 106 and the optical fibers 108. The optical fibers 108 include a set of light-emitting fibers 120 and a set of light-detecting fibers 122. The light-emitting fibers 120 and the light-detecting fibers 122 are input to the signal analyzer in the control unit 110. The light-detecting fibers 122 are positioned on a diametrically opposite side of the opening 104 from the light-emitting fibers 120. Each light-emitting fiber 120 emits a beam of light 124 which is received by a correspondingly positioned light-detecting fiber 122 on the opposite side of the opening 104. The optical fibers 108 provide light signals to be used in determining the quality of the object 103 in a manner well known in the art, while the light-emitting fibers 120 and the light-detecting fibers 122 provide light signals to determine the presence of an object passing through the opening 104 of the head 106.

The light beams 124 are projected to intercept the flow of the objects 103 through the central opening 104, preferably substantially perpendicular to the flow. The light beams 124 form a plane or curtain of light 126 through which the objects flow. A sufficient number and size of light beams 124 are used to form the curtain with a width across the opening larger than the maximum anticipated width of the object 103 to pass through the opening 104, thereby the objects then only partially obstruct the curtain 126 as they fall through the opening 104. For products the size of coffee beans, this dimension would preferably be ten millimeters.

An upper focusing ring 123 and a lower focusing ring 125 preferably surround ring 117 and thus the ends of the optical fibers 108, the light-emitting fibers 120 and the light-detecting fibers 122. The upper and lower focusing rings are fixed to the head unit 115 by adjusting screws 119. The adjusting screws 119 may be adjusted to provide a variable width gap 121 between the upper and lower focusing rings 123 and 125. As the upper focusing ring 123 and the lower focusing ring 125 are brought closer together by tightening adjusting screws 119, an edge of these tings surrounding the opening 104 close over and partially cover the ends of the fibers. By decreasing the width of the gap 121, and thereby partially covering the ends of the fibers, the field of view of the fibers is restricted. Preferably, the gap 121 may be adjusted from a 1 millimeter width providing less focused analysis of an object, to a 0.4 millimeters gap providing a more focused analysis of an object. Thus, the thickness of the curtain, measured axially to the flow of the objects, is adjustable by adjusting the gap 121 by means of the adjusting screws 119.

Although three light-emitting fibers 120 and three corresponding light-detecting fibers 122 are shown, those skilled in the art will recognize that a greater or lesser number of light-emitting fibers 120 and corresponding light-detecting fibers 122 may be used. Additionally, although optical fibers are described herein, it is to be understood that any method of creating a plane or curtain of light through which the objects flow may be used.

Figure 3C:
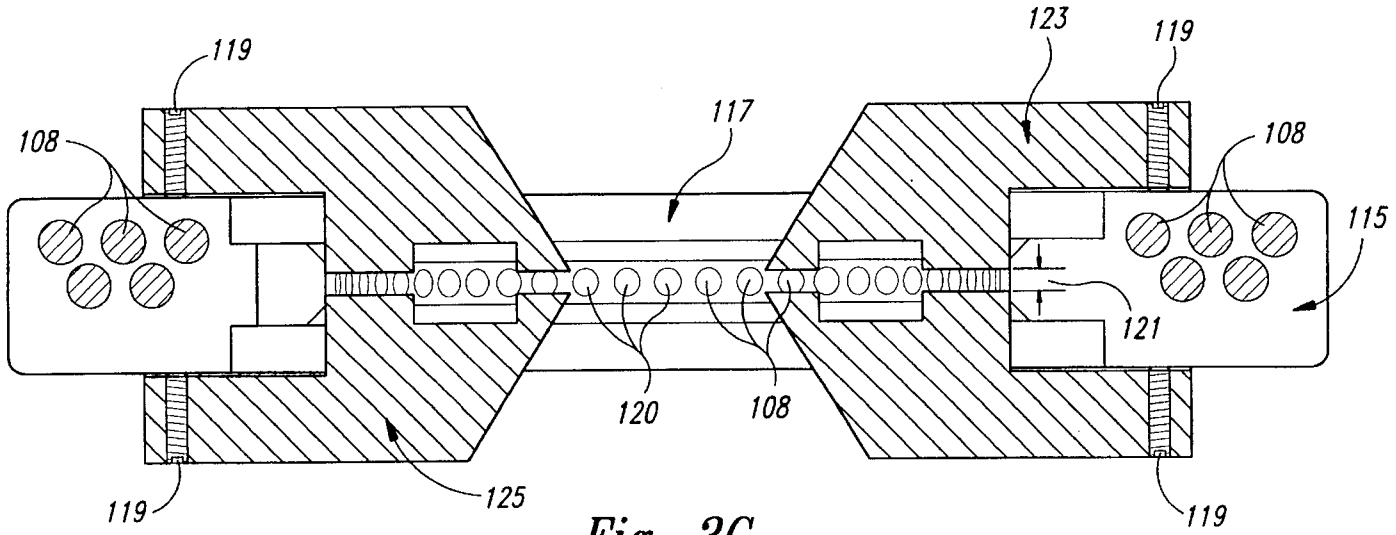
FIG. 3C is an enlarged, cross-sectional side view of the analysis head taken substantially along line 3B—3B of FIG. 2, showing upper and lower focusing rings in cross-section.

An object 128 is shown in FIG. 3 A in dashed lines within the opening 104 interrupting one of the light beams 124. As the object 128 passes through the opening 104, only two of the three light-detecting fibers 122 receives light. This interruption of the light beam is used to detect the presence of the object. A larger object 130 is also shown in dashed lines obstructing two of the three light beams 124. As the larger object 130 passes through opening 104, only one of the three light-detecting fibers 122 receives light.

Figure 4:
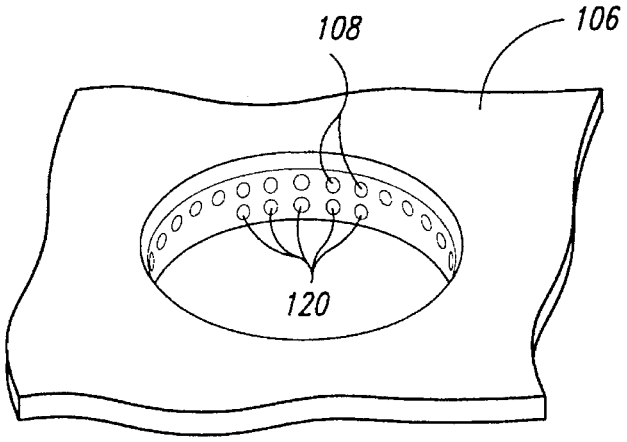
FIG. 4 is an enlarged, fragmentary isometric view of an alternative embodiment of the analysis head of FIG. 2.

An alternative embodiment of the analysis head 106 is shown in FIG. 4 using two rows of optical fibers. In this alternative embodiment, the optical fibers 108 are positioned is a plane above the plane in which the light-emitting fibers 120 and the light-detecting fibers 122 are positioned. Although the analysis head 106 is shown as an annular ring having optical fibers circumferentially spaced apart around its inner surface, those skilled in the art will appreciate that other arrangements are possible where optical detectors receive a portion of light as objects pass through and obstruct a light beam or curtain. The description of the detailed circuitry which follows will use the analysis head 106 with the single row arrangement shown in FIGS. 3A and 3B.

Figure 5:
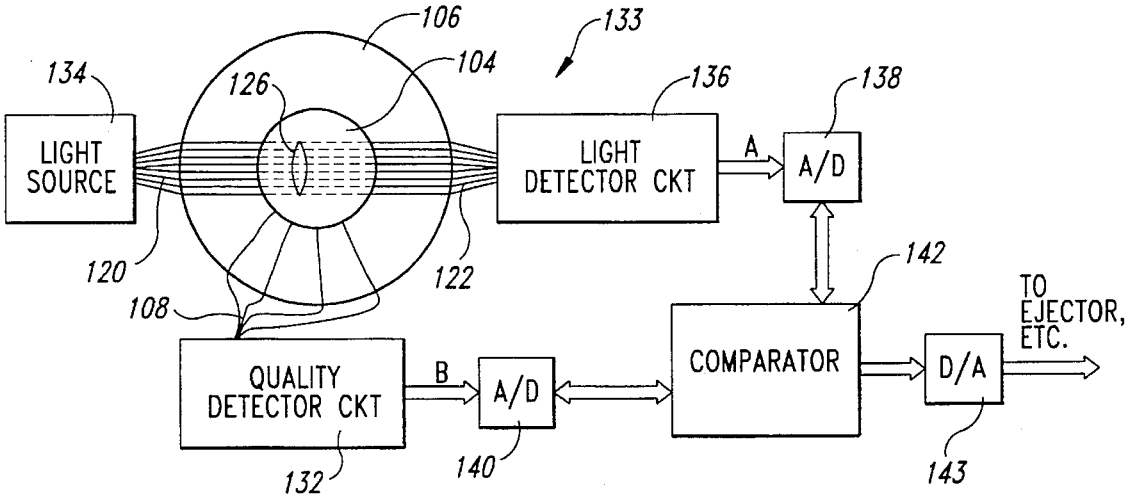
FIG. 5 is a block diagram of the circuitry used with the sorting apparatus of FIG. 1.

The basic analysis circuitry of the apparatus 110 is shown in FIG. 5, and includes an optical quality detector circuit 132 and an optical interrupt detector circuit 133. The signals from the interrupt detector circuit 133 and the quality detector circuit 132 are converted from analog to digital in analog-to-digital converters 138 and 140, respectively. Although two analog-to-digital (A/D) converters are shown, a single A/D converter may be used. The digitized signals are input to a comparator 142. The comparator 142 determines whether to eject an object. Comparator 142 is preferably a microprocessor or central processing unit (CPU) 144 executing an appropriate routine 200. The CPU 144 and the routine 200 are described more fully below with respect to FIGS. 6 and 7, respectively.

The quality detector circuit 132 is of a conventional design and receives light from the optical fibers 108 spaced around the analysis head 106. The quality detector circuit 132 is preferably of the type described in U.S. Pat. No. 4,718,558, by the same inventor, incorporated herein by reference. In this patent, a pair of light receivers have different electronic responses to predetermined wavelengths of light received from the optical fibers 108. Thus, the quality detector circuit 132 outputs two different quality signals based on the wavelengths of light reflected from an object passing through the opening 104 of the analysis head 106. The quality detector circuit 132 produces signals having varying amplitudes, signals similar to that shown in FIG. 9 as signal B. The two quality signals B are appropriately amplified and input to the A/D converter 140, where they are digitized. The digitized quality signals are then input to comparator 142. The signals transferred between the quality detector 132, the A/D converter 140, and the comparator 142, and all other signals in the system, may be transferred over a plurality of lines, as in a data bus, or over a single line. Single line transmission may require a multiplexer circuit for multiplexing the signals, as is known by those skilled in the art.

The interrupt detector circuit 133 includes an infrared light source 134 directing light, through the light-emitting fibers 120, across the opening 104 in the analysis head 106, and an infrared light detector 136 which receives the light received through the light-detecting fibers 122. The light produced by the light source 134 is preferably infrared light of a predetermined frequency. The light detector 136 is preferably a photo transistor responsive to only infrared light of that predetermined frequency.

In an alternative embodiment, the light source 134 produces pulses of light at a predetermined frequency. The light detector 136 is tuned to this predetermined frequency, and thus, only light pulses at this frequency are detected. Additional appropriate circuitry, known to those skilled in the art, is required for this alternative embodiment, such as oscillator circuitry. In this alternative embodiment, the system is immune to background infrared radiation and would be ideal for environments where background infrared radiation is prevalent. Those skilled in the art will recognize that other forms of electromagnetic radiation may be used in the present invention and any appropriate light-to-electricity transducer may be used to detect this light.

The light received by the light detector 136 is converted into electrical signals, which are then appropriately amplified by an amplifier (not shown). As an object passes through and obstructs the light curtain 126, a varying amount of light is detected by the light detector 136, resulting in an amplified signal having a varying amplitude, similar to that shown in FIG. 10 as signal A. The amplified signal A is digitized in the A/D converter 138 and input to the comparator 142.

The A/D converters 138 and 140 convert the current value of the analog signals A and B into a digital value upon receipt of an appropriate control signal from the comparator 142. The analog signals output by the light detector circuit 136 and quality detector circuit 132 are continuously sampled at the rate of the A/D converters, and a string of digital values representing the immediate amplitudes of these analog signals are produced and input to the comparator 142.

Each object passing through the light beams 124 produces a pulse in the signal A produced by the light detector circuit 136. The greatest amplitude of the pulse corresponds to the widest portion of the object as it passes through and obstructs the largest number of the light beams 124. The peak of this pulse coincides with the largest cross-sectional area of the object, which substantially coincides with the center of gravity of the object. The center of gravity is an ideal point at which to base timing of the ejector mechanism if an undesired object is detected. In the preferred embodiment, the CPU 144 determines the peak of each pulse in the signal A output from the light detector 136.

The quality detector circuit 132 also produces a pulse in signal B in response to each object. Thus, each pulse in signals A and B from light detectors 136 and quality detector circuit 132, respectively, correspond to an object passing through the analysis head 106.

Figure 11:
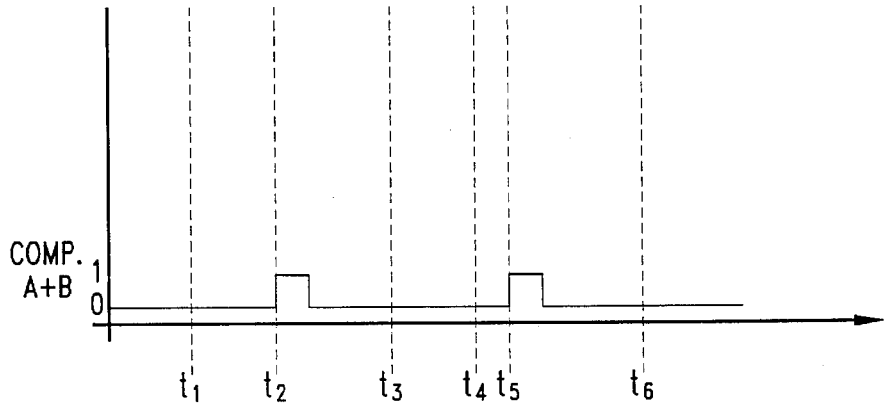
FIG. 11 shows a typical signal outputted by the comparator 142 from a correlation of the signals shown in FIGS. 9 and 10.

The comparator 142 outputs a signal to control ejection of an undesired object when both an object is detected by the interrupt detector circuit 133, and an object of unacceptable quality is detected by the optical quality detector circuit 132. FIG. 11 is an example of the type of signal output by the comparator 142 in response to the input signals A and B. The signal output by the comparator 142 is converted from digital to analog in digital-to-analog (D/A) converter 143, and input to an ejector mechanism (not shown) to eject the undesired object. The signal from the comparator 142 is converted to an appropriate analog signal by the D/A converter 142 for the ejector mechanism. Depending upon the type of ejector mechanism employed, the signal output from the D/A converter 143 may require amplification. The ejector mechanism is of conventional design utilizing a blast of air to knock the object laterally after it clears the analysis head 106 if it is detected as being of undesirable quality by the optical quality detector circuit 132. An algorithm executed by the CPU 144 computes the appropriate time to eject an undesired object.

Signals produced by the present invention will now be discussed with respect to an exemplary series of typical objects, for example, beans, shown in FIG. 8 passing through the opening 104 of the analysis head 106.

Figure 9:
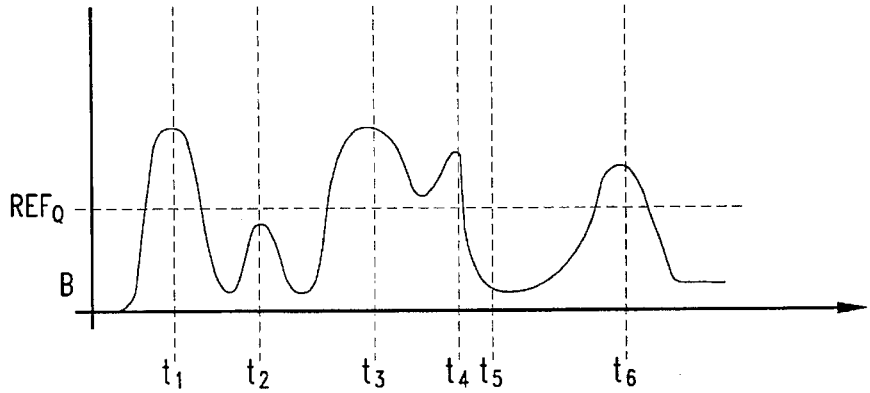
FIG. 9 shows a typical signal with a series of pulses produced by the quality detector 132 in response to the series of beans shown in FIG. 8.
Figure 10:
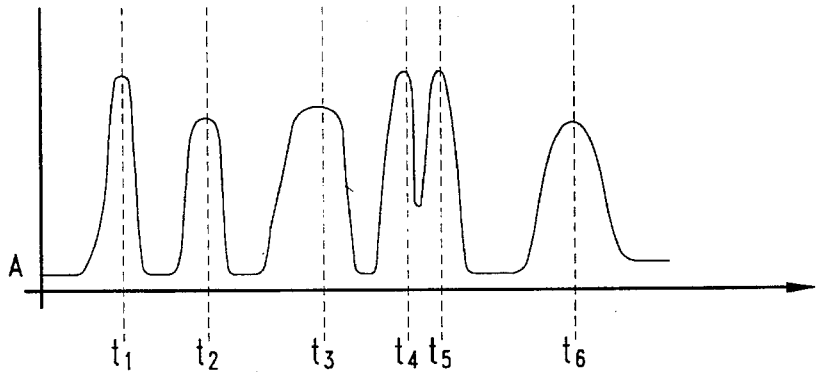
FIG. 10 shows a typical signal with a series of pulses produced by the interrupt detector 133 of the present invention in response to the series of beans shown in FIG. 8.
Figure 8:
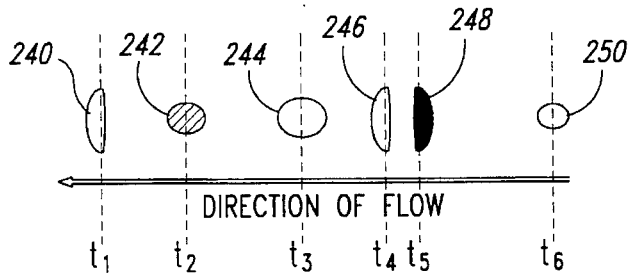
FIG. 8 shows a typical series of beans or other objects traveling through the analysis head shown in FIG. 2.

FIG. 8 shows beans 240, 242, 244, 246, 248, and 250 moving in a direction from fight to left which simulates the beans falling through the opening 104 and producing peaks in FIGS. 9 and 10 at times $t_1$, $t_2$, $t_3$, $t_4$, $t_5$, and $t_6$, respectively. Referring first to the signals produced by the optical quality detector circuit 132, as the beans fall through the opening 104 of the analysis head 106, the light reflected from a bean is received by the light receivers, producing a series of electrical pulses of differing amplitude depending upon the wavelengths of light reflected from the bean. FIG. 9 shows such a typical signal B so produced in response to the series of beans shown in FIG. 8. The beans 240, 244 and 246 are of good quality and reflect ample light at the predetermined wavelength to cause the quality detector 132 to produce peaks at times $t_1$, $t_3$, and $t_4$. These peaks are above a predetermined reference value $Ref_Q$ shown in FIG. 9.

The bean 242 has unacceptable color and so absorbs much of the light at the predetermined wavelength. As a result, the quality detector 132 outputs a pulse having a peak at time $t_2$ which is below the reference value $Ref_Q$. Similarly, the bean 248 has a very dark solid color. The light incident on the bean 248 is absorbed by the bean, and little, if any, is reflected to the quality detector 132. The quality detector 132 therefore outputs a signal B below the reference value $Ref_Q$, as shown in FIG. 9 at time $t_5$.

Referring now to the signals produced by the interrupt detector circuit 133, as the beans fall through the opening 104 of the analysis head 106 and sequentially obstruct a portion of the light curtain 126, the light received by the light detector 136 causes the light detector 136 to output a series of pulses in an electrical signal having a shape similar to a half-wave rectified sinusoidal signal. FIG. 10 shows such a signal A produced by the light detector 136 in response to the beans 240–250 shown in FIG. 8. The greatest amplitude of each pulse in the signal A corresponds to the widest portion of a bean as it passes through and obstructs the largest portion of the light beams 124, coinciding with the center of gravity of the bean. Knowing the time at which the center of gravity of an object is between the light-emitting fibers 120 and the light-detecting fibers 122 in the analysis head 106, and knowing the rate at which an object falls under the influence of gravity, the appropriate timing to activate the ejector mechanism to eject an undesirable bean may be readily calculated.

The beans 246 and 248 cause the light detector 136 to produce peaks at times $t_4$ and $t_5$, respectively, as they pass through the light curtain 126. As can be seen from comparing the signals produced by the beans 240 and 248, the interrupt detector 133 produces similar signals for similarly sized beans, irrespective of the surface color of the bean. The bean 250 is smaller than the bean 244 and therefore produces a peak in the signal A at time $t_6$ smaller than the peak produced by the bean 244 at time $t_3$. If necessary, the comparator 142 may adjust timing of the ejector mechanism to compensate for various sized objects. Those skilled in the art will recognize that the value of the peak amplitude of a pulse indicates the size of an object. Thus, any appropriate routine known in the art to calculate and adjust the timing may be used.

In the preferred embodiment, the time at which the center of gravity of an undesired object passes through the light plane 126 is used to start the timing for activating the ejector mechanism. In FIG. 9, the bean 242 is undesired due to its unacceptable color and results in a pulse at time $t_2$ below the reference value $Ref_Q$. In FIG. 10, the center of the bean 242 is shown to coincide with a peak in the signal A at time $t_2$. The correlation of this peak with the pulse in FIG. 9 produces an output pulse having a logical "1" state in FIG. 11 from the comparator 142, initiating the timing used for the ejector mechanism.

The center of the bean 242 passes through the light curtain 126 at time $t_2$. The center of cross-sectional area of the bean 242 closely corresponds to its center of gravity. The output pulse used to initiate ejection of this bean is output from the comparator 142 at time $t_2$. Therefore, the ejection of this bean is properly timed to its center of gravity, assuming the ejector mechanism is properly adjusted to eject a bean after receiving the bean's pulse.

Similarly, the undesired bean 248 produces a signal at time $t_5$ in FIG. 9 below the reference value $Ref_Q$. This bean 248 produces a peak in FIG. 10 at time $t_5$, corresponding to its center. The correlation of no pulse in FIG. 9 with a peak in FIG. 10 causes comparator 142 to produce an output pulse having a logical "1" state in FIG. 13. This logical "1" state pulse initiates timing of the ejector mechanism. Again, the center of gravity of the bean 248 passes through the light plane 126 at time $t_5$. The pulse output from the comparator 142 to initiate ejection of this bean is also output at time $t_5$. Ejection of this bean is properly timed to its center of gravity.

Based on the above, the comparator 142 preferably outputs a signal or pulse to eject a bean of unacceptable quality based on the following truth table:

| AB | A · B |
|---|---|
| 00 | 0 |
| 01 | 0 |
| 10 | 0 |
| 11 | 1 |

Figure 6:
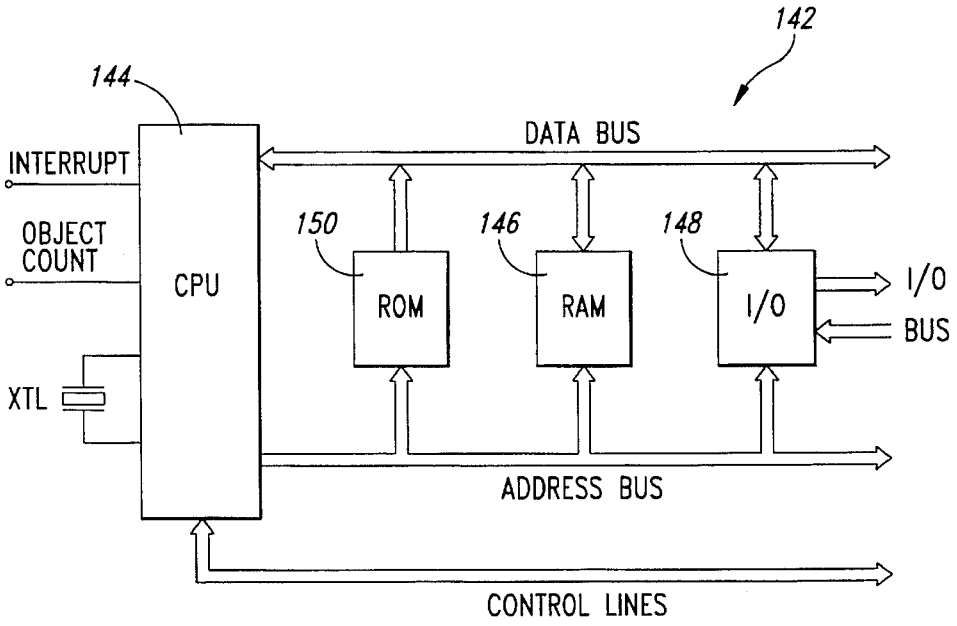
FIG. 6 is a block diagram of a comparator used with the sorting apparatus of FIG. 1.

Signal A: Interrupt signal
"0" = no object detected; "1" = object detected
Signal B: Quality signal
"0" = object of acceptable quality; "1" = object of unacceptable quality The preferred embodiment of the comparator 142 for performing the above truth table is shown in FIG. 6, and includes the CPU 144 and random access memory (RAM) 146. The digitized signals from A/D converters 138 and 140 are input to RAM 146. The samples are read from and manipulated by the CPU 144. The CPU has, in addition to the RAM 146 operating therewith, appropriate input/output circuitry 148 and a read-only memory (ROM) 150 for the displays, controls and routines of the signal analyzer 109.

The CPU 144 has appropriate address bus, data bus, and control lines. The CPU 144 also includes interrupt and object count inputs to provide automatic gain control and other features of the circuit described in U.S. Pat. No. 4,718,558. A crystal provides a constant clock rate for the CPU 144 (shown as "XTL" in FIG. 6) and other circuits in the present invention requiring appropriate timing, as is known to those skilled in the art.

As an object begins to pass through the light beams 124, the interrupt detector 133 produces a signal A of increasing amplitude. In response to this signal, the A/D converter 138 continuously samples this signal and produces samples having increasing value. These values are stored in RAM 146, to be processed by the CPU 144. Similarly, the values of the digitized signal B outputted from A/D converter 140 are stored in the memory 146 for processing by the CPU 144. Alternatively, the CPU 144 may process an immediate value outputted by either A/D converter 138 or 140.

Figure 7:
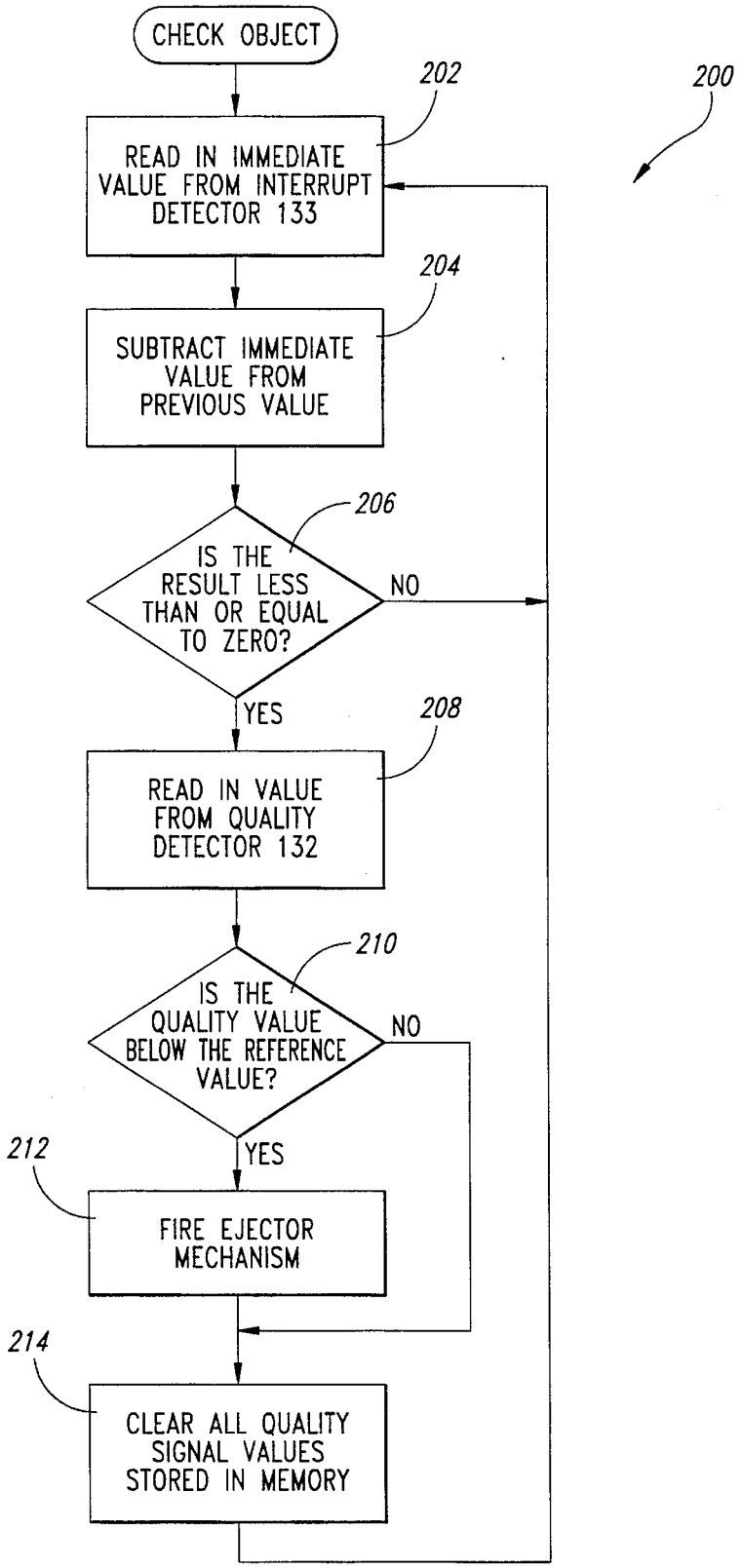
FIG. 7 is a flow chart showing an example of instructions executed by the comparator 142 of the present invention.

The CPU 144 determines the peak of the signals A and B output by the light detectors 136 and the quality detector circuit 132, respectively, by using any suitably convenient reiterative sorting routine. The routine may be stored in the ROM 150. FIG. 7 shows an example of the steps in a sorting routine 200 performed by the CPU 144. The routine 200 begins by reading in the immediate value from the interrupt detector circuit 133, in step 202. In step 204, this immediate value is compared or subtracted from the previous value, which has been stored in memory. As each new value is input to the CPU 144, it is subtracted from the previous value. When the result changes sign (e.g., from positive to negative), a peak in the inputted signal has been found. Restating, when a previous value is equal to or greater than the immediate value, the approximate peak of the pulse has been reached and the previously stored value is assumed to be the peak value of the pulse.

Therefore, in step 206, if the result of subtracting the immediate value from the previous value is greater than zero, then the peak has not been reached and the CPU 144 again reads in the next (i.e., immediate) value from the interrupt detector 133 in step 202. Alternatively, if the result is less than or equal to zero in step 206, then the CPU 144 reads in the value from the quality detector 132, in step 208. The CPU 144 may either read in the immediate value from the quality detector 132 or a value stored in the memory 146. Preferably, the CPU 144 processes the lowest digitized quality value for the particular object currently within the analysis head 106.

In step 210, the quality value read into the CPU 144 is compared with a reference value $Ref_Q$. If the quality value is below the reference value (step 210), then the CPU 144 outputs a signal to fire the ejector mechanism 113, such as the deflecting means discussed in U.S. Pat. No. 4,057,146 in step 212. After step 212, or if the quality value is above the reference value, all quality signal values stored in memory are cleared from the memory in step 214. Thereafter, the CPU 144 begins again by reading in the immediate value from the interrupt detector 133 in the step 202.

Applying the routine 200 to the beans shown in FIG. 8, the CPU 144 determines that the bean 240 produces a peak at time $t_1$ in the interrupt signal A during step 206. In step 210, the CPU 144 determines that the bean 240 is of acceptable quality because it produces a pulse in signal B above $Ref_Q$. Thus, the CPU 144 outputs a logical "0" state signal at time $t_1$.

Conversely, the bean 242 has an undesired color and is, therefore, of unacceptable quality. The CPU 144 in step 206 determines that this bean produces a peak at time $t_2$ in the interrupt signal A. In step 210, the CPU 144 determines that the value of the quality signal outputted as a result of this bean is below the reference value $Ref_Q$. Consequently, the CPU 144 outputs a logical "1" state signal at time $t_2$ in response to the bean 242 to a D/A converter 143 indicating that the bean should be rejected.

The CPU 144 also outputs a signal to control ejection of an undesired bean when both a bean is detected (signal A) and the quality detector 132 does not sense the presence of a bean (signal B). The very dark bean 248 absorbs most incident light, thus the signal B output from the quality detector 132 is determined in step 210 to be below the threshold reference value $Ref_Q$. As the bean 248 passes through the light beams 124, it causes the light detector 136 to output a peak at time $t_5$ in FIG. 10, as determined in step 208. The CPU 144 again produces a logical "1" state signal in FIG. 11 at time $t_5$ indicating that the bean 248 is to be ejected.

In an alternative embodiment, the routine 200 determines the peak value based upon the derivative of the input signal. As is well known, the derivative of a signal is zero at the position of its peak amplitude. Thus, a zero value occurring from a transition from positive to negative values indicates a peak. In a further alternative embodiment, the CPU 144 in step 204 compares the immediate value with a predetermined value, the predetermined value being an average maximum width of an object to be sorted. When the immediate value equals or exceeds the predetermined value, the approximate center or peak of the object has been found. Those skilled in the art may use any suitable routine to execute either of these alternative embodiments.

As noted above, the width of the light beams 124 are preferable within the range of 0.4 to 1.0 millimeter. Because of this relatively large width as compared to the size of most objects sorted by the present invention, false peaks in the signal A potentially caused by rough surface contours in an object are eliminated. Of course, if an object has such surface imperfections as to have notches or chips greater than the width of the light beams 124, false peaks in the signal A could arise.

To avoid possible false peaks in the signal A, the CPU 144 reads in several values from the interrupt detector 133 and averages them. This average value is then subtracted from a previously computed average value. If the result is less than or equal to zero, the value from the quality detector 132 is read in step 208. This same averaging method may be used with the values from the quality detector 132. For example, five values for an object may be averaged, and this average value then compared with the reference value $Ref_Q$ to determine if the object is of acceptable quality.

In the alternative embodiment of the analysis head 106 shown in FIG. 4, the quality detecting optical fibers 108 are in a plane above the plane in which the light-emitting fibers 120 and the light-detecting fibers 122 are positioned. Consequently, an object intersects these two planes at different times, producing a quality signal as shown in FIG. 9 which is shifted slightly in time from the interrupt signal as shown in FIG. 10. The routine executed by CPU 144 includes an appropriate delay routine to properly time ejection of the object. Alternatively, appropriate delay circuits may be included in the signal analyzer 109 to compensate for this time difference and to permit appropriate timing for the ejector mechanism.

The present invention is shown and described in terms of block diagrams, flow charts and signals to provide those skilled in the art with the appropriate information necessary to construct the present invention. Those skilled in the art will recognize many variations for the components described above. For example, any number and type of light detectors may be used, including photo diodes, charge coupled devices (CCDs), and so forth. Those skilled in the art will also recognize that additional circuitry may be needed to construct the present invention. For example, the signals output from the light detectors may require current-to-voltage converters and amplification before being input to A/D converters 138 and 140. Voltage limiters may be necessary to decrease the voltages of the signals down to the +5 volt standard used with the CPU 144. The comparator 142 may alternatively perform the above described functions using instead TTL logic circuitry rather than a routine performed by the CPU 144.

Although specific embodiments of the invention have been described for purposes of illustration, various modifications may be made without departing from the spirit and scope of the invention. Accordingly, the invention is not limited by the disclosure, but instead its scope is to be determined entirely by reference to the following claims.

We claim:

1. An optical sorting apparatus for sorting individual objects falling along an unimpeded path, the objects being illuminated by light, the apparatus comprising:

an analysis circuit having a first light element positioned in a plane intercepting the unimpeded path and detecting an amount of light reflected from the objects as the objects pass though the plane intercepting the unimpeded path, and producing a light signal related to the amount of light reflected from the objects;

an interrupt detecting circuit having second and third light elements positioned in the plane, the second light element producing a light path substantially in the plane intercepting the unimpeded path, and the third light element producing a presence signal indicating that an object is present within the plane; and a comparator circuit, adapted to receive the light signal and the presence signal, producing an ejection signal directing ejection of the object if the light signal is unacceptable as compared with a predetermined value, and the presence signal and the light signal are correlated.

2. The optical sorting apparatus according to claim 1 wherein the interrupt detector circuit produces the presence signal when the center of the object is within the light path.

3. The optical sorting apparatus according to claim 1 wherein the plane of light is wider than the objects.

4. The optical sorting apparatus according to claim 1 wherein the interrupt detecting circuit produces the presence signal having a peak amplitude when the object is present within the light path; and wherein the comparator circuit produces the ejection signal in response to the peak amplitude.

5. The optical sorting apparatus according to claim 1 wherein the comparator circuit includes a central processing unit adapted to receive the light signal and the presence signal, and which produces the ejection signal.

6. An optical sorting apparatus for sorting individual objects falling along an unimpeded path, the objects being illuminated by light, the apparatus comprising:

an analysis assembly positioned relative to the unimpeded path having first, second and third light elements positioned in a plane intercepting the unimpeded path;

a quality detector circuit coupled to the first light element, the first light element adapted for receiving light reflected from the objects, as the objects pass through the plane intercepting the unimpeded path and producing a quality signal related to the amount of light reflected from an object;

an interrupt detector circuit coupled to the second and third light elements, the second light element adapted for producing light substantially in the plane intercepting the unimpeded path, and the light being received by the third light element, the interrupt detector circuit adapted for producing a presence signal indicating that an object is present within the plane in response to the light received by the third light element; and a comparator circuit adapted for comparing the quality signal to a reference value and producing a first signal if the quality signal is unacceptable as compared to the reference value, and adapted to receive the presence signal, the comparator circuit producing a ejection signal directing an ejection of the object from the unimpeded path if the presence signal and the first signal are correlated.

7. The optical sorting apparatus according to claim 1 wherein the first, second and third light elements are optical fibers.

8. The optical sorting apparatus according to claim 1 wherein the analysis assembly includes a member having an opening through which the objects fall along the unimpeded path, and the first, second and third light elements are positioned around the opening.

9. The optical sorting apparatus according to claim 8 wherein the analysis assembly may be adjusted to restrict the light received by the first, second and third light elements.

10. The optical sorting apparatus according to claim 6 wherein the plane of light is wider than the objects.

11. The optical sorting apparatus according to claim 6 wherein the plane of light is emitted at a predetermined frequency and the light detector is adapted to receive light only at the predetermined frequency.

12. The optical sorting apparatus according to claim 6 wherein the plane of light is emitted as pulses of light at a predetermined frequency produced by the light emitter and the light detector is adapted to receive light pulses only at the predetermined frequency.

13. The optical sorting apparatus according to claim 6 wherein the interrupt detector circuit produces the presence signal as having peaks of varying amplitude, each peak corresponding to a time at which the center of an individual object is within the plane of light.

14. The optical sorting apparatus according to claim 13 wherein the comparator circuit produces the ejection signal proximate in time to the peak of the presence signal.

15. An optical sorting apparatus for sorting individual objects falling along an unimpeded path, the objects being illuminated by light, the apparatus comprising:

an analysis assembly positioned relative to the unimpeded path having first, second and third light conductors wherein the first, second and third light conductors are positioned in a plane intercepting the unimpeded path;

a quality detector circuit having a light receiver coupled to the first light conductor, the light receiver adapted for receiving light reflected from the objects and producing a quality signal related to the amount of light reflected from an object;

an interrupt detector circuit having a light emitter coupled to the second light conductor, and a light detector coupled to the third light conductor, the light emitter adapted for producing a plane of light intercepting the unimpeded path, the plane of light being received by the light detector, the light detector adapted for producing a presence signal indicating that an object is present within the plane of light; and a comparator circuit adapted for comparing the quality signal to a reference value and producing a first signal if the quality signal is unacceptable as compared to the reference value, and adapted to receive the presence signal, the comparator circuit producing an ejection signal directing ejection of the object from the unimpeded path if the presence signal and the first signal are correlated.

16. An optical sorting apparatus for sorting individual objects falling along an unimpeded path, the objects being illuminated by light, the apparatus comprising:

an analysis assembly positioned relative to the unimpeded path having first, second and third light conductors wherein the second and third light conductors are positioned in a plane intercepting the unimpeded path;

a quality detector circuit having a light receiver coupled to the first light conductor, the light receiver adapted for receiving light reflected from the objects and producing a quality signal related to the amount of light reflected from an object;

an interrupt detector circuit having a light emitter coupled to the second light conductor, and a light detector coupled to the third light conductor, the light emitter adapted for producing a plane of light intercepting the unimpeded path, the plane of light being received by the light detector, the light detector adapted for producing a presence signal indicating that an object is present within the plane of light; and a comparator circuit adapted for comparing the quality signal to a reference value and producing a first signal if the quality signal is unacceptable as compared to the reference value, and adapted to receive the presence signal, the comparator circuit producing an ejection signal directing ejection of the object from the unimpeded path if the presence signal and the first signal are correlated.

17. A method of sorting objects falling along an unimpeded path, the objects being illuminated by a light source, the method comprising the steps of:

providing first, second and third light elements positioned in a plane intercepting the unimpeded path;

detecting, using the first light element, an amount of light reflected from the objects as the objects pass through the plane intercepting the unimpeded path;

producing a quality signal if the amount of light reflected from the objects indicates unacceptable quality when compared with a first predetermined value;

producing light, using the second light element, substantially along the plane intercepting the unimpeded path;

receiving, using the third light element, light produced by the second light element;

producing a presence signal in response to the light received by the third light element indicating that an object is present within the plane; and producing an ejection signal to eject an object from the unimpeded path when the quality signal and the presence signal are substantially simultaneously produced.

18. The method according to claim 17 wherein the presence signal is produced when the center of the object is within the plane of light.

19. The method according to claim 17, further comprising the step of:

adjusting the time at which the ejection signal is produced based upon the presence signal.

20. The method according to claim 17 wherein the step of producing a presence signal includes the steps of:

producing an interrupt signal having a peak amplitude when the object is present within the plane of light; and producing the presence signal in response to the peak amplitude.

21. A method of sorting objects falling through an optical sorting apparatus, the optical sorting apparatus producing a quality signal indicating an amount of light reflected from an object and an interrupt signal having a varying value, the interrupt signal indicating the presence of the object at a position within the sorting apparatus, the method comprising the steps of:

providing, first, second and third light elements positioned in a plane intercepting an unimpeded path;

producing, using the second light element, light substantially along the plane;

receiving, using the third light element, the light and producing an interrupt signal;

finding the substantial center of the object based on the interrupt signal;

producing, using the first light element, a quality signal of the object;

determining the quality of the object based on the quality signal; and producing a signal, when the substantial center of the object is found, indicating that the object is to be ejected if the quality is unacceptable.

22. The method of sorting objects according to claim 21, further comprising the step of adjusting the timing of the object to be ejected based upon the interrupt signal value.

23. A method of sorting objects falling through an optical sorting apparatus, the optical sorting apparatus producing a quality signal indicating an amount of light reflected from an object and an interrupt signal having a varying value, the interrupt signal indicating the presence of the object at a position within the sorting apparatus, the method comprising the steps of:

providing first, second and third light elements positioned in a plane intercepting the unimpeded path;

finding the substantial center of the object based on the interrupt signal including the steps of:

producing, using the second light element, light substantially along the plane interrupting the unimpeded path;

receiving using the third light element, the light produced by the second light element and producing an interrupt signal value; and comparing the interrupt signal value with a certain value and producing a result;

producing, using the first light element, the quality signal of the object;

determining the quality of the object based on the quality signal; and producing a signal, when the substantial center of the object is found, indicating that the object is to be ejected if the quality is unacceptable.

24. The method of sorting objects according to claim 23 wherein the certain value is a previous interrupt signal value and the step of comparing includes the step of subtracting the interrupt signal value from the previous interrupt signal value.

25. The method of sorting objects according to claim 23 wherein the certain value is the average width of objects falling through the optical sorting apparatus.

26. The method of sorting objects according to claim 23 wherein the step of comparing includes the step of differentiating and the certain value is zero.

27. The method of sorting objects according to claim 23 Wherein the step of determining the quality includes the step of reading the quality signal if the result is less than or equal to a predetermined value.

28. The method of sorting objects according to claim 24 wherein the predetermined value is zero.

29. The method of sorting objects according to claim 24 wherein the step of reading the quality signal occurs when the widest portion of the object is at the position within the sorting apparatus.

* * * * *

UNITED STATES PATENT AND TRADEMARK OFFICE

CERTIFICATE OF CORRECTION

| | | |
|---|---|---|
| PATENT NO. | : | 5,562,214 |
| DATED | : | October 8, 1996 |
| INVENTOR(S) | : | Fernando Castañeda and Arturo C. Aguero |

It is certified that error appears in the above identified patent and that said Letters Patent is hereby corrected as shown below:

In column 11, claim 7, line 51, please delete "1" and insert therefor --6--.

In column 11, claim 8, line 54, please delete "1" and insert therefor --6--.

In column 14, claim 23, line 23, immediately following "receiving" please insert --,--.

In column 14, claim 27, line 47, please delete "Wherein" and insert therefor --wherein--.

Signed and Sealed this
Twenty-eighth Day of January, 1997

*Attest:*

Bruce Lehman

BRUCE LEHMAN

*Attesting Officer* *Commissioner of Patents and Trademarks*